US009085998B2

(12) United States Patent
Satsumabayashi

(10) Patent No.: US 9,085,998 B2
(45) Date of Patent: Jul. 21, 2015

(54) ENGINE VENTILATION APPARATUS

(75) Inventor: Shin Satsumabayashi, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/342,687

(22) PCT Filed: Sep. 6, 2011

(86) PCT No.: PCT/JP2011/070242

§ 371 (c)(1),
(2), (4) Date: Mar. 4, 2014

(87) PCT Pub. No.: WO2013/035154

PCT Pub. Date: Mar. 14, 2013

(65) Prior Publication Data

US 2014/0202438 A1 Jul. 24, 2014

(51) Int. Cl.

| | |
|---|---|
| ***F02B 13/00*** | (2006.01) |
| ***F01M 13/00*** | (2006.01) |
| ***F01M 13/04*** | (2006.01) |
| *F01M 11/02* | (2006.01) |

(52) U.S. Cl.

CPC ..... *F01M 13/00* (2013.01); *F01M 13/04* (2013.01); *F01M 13/0416* (2013.01); *F01M 2011/023* (2013.01); *F01M 2013/0488* (2013.01)

(58) Field of Classification Search

CPC ..... F01M 13/04; F01M 2011/023; F01M 2013/0488

USPC ..... 123/572, 573, 574, 41.86

See application file for complete search history.

(56) References Cited

U.S. PATENT DOCUMENTS

| | | | | |
|---|---|---|---|---|
| 4,502,424 | A | 3/1985 | Katoh et al. | |
| 4,769,050 | A | 9/1988 | Shaw et al. | |
| 6,167,849 | B1 * | 1/2001 | Wilson | 123/41.86 |
| 2005/0224061 | A1 * | 10/2005 | Ulrich et al. | 123/573 |
| 2006/0254566 | A1 * | 11/2006 | Yasuhara | 123/572 |
| 2007/0181107 | A1 * | 8/2007 | Shieh | 123/572 |

(Continued)

FOREIGN PATENT DOCUMENTS

| | | |
|---|---|---|
| JP | 62-49607 | 3/1987 |
| JP | 63-130607 | 8/1988 |
| JP | 05-039709 | 2/1993 |

(Continued)

OTHER PUBLICATIONS

International Search Report Issued Dec. 13, 2011 in PCT/JP11/070242 Filed Sep. 6, 2011.

(Continued)

*Primary Examiner* — Lindsay Low
*Assistant Examiner* — Long T Tran
(74) *Attorney, Agent, or Firm* — Oblon, McClelland, Maier & Neustadt, L.L.P.

(57) ABSTRACT

A ventilation apparatus for an engine is provided with a recirculation passage for causing blow-by gas in a crank case to flow back into an intake passage of an engine. The ventilation apparatus is also provided with an oil return passage for returning oil to an oil pan. In the oil return passage, a common portion is formed, which is an internal space shared with the recirculation passage and into which oil falls under its own weight. Specifically, the portion of the oil return passage including the common portion extends in the vertical direction.

6 Claims, 3 Drawing Sheets

(56) References Cited

U.S. PATENT DOCUMENTS

| | | | | |
|---|---|---|---|---|
| 2009/0241921 | A1* | 10/2009 | Ito et al. | 123/573 |
| 2013/0213370 | A1* | 8/2013 | Shirabe et al. | 123/574 |

FOREIGN PATENT DOCUMENTS

| | | | |
|---|---|---|---|
| JP | 09-053432 | | 2/1997 |
| JP | 2005-140104 | A | 6/2005 |
| JP | 2008-121478 | | 5/2008 |

OTHER PUBLICATIONS

English translation of the International Preliminary Report on Patentability issued Mar. 6, 2014, in PCT/JP2011/070242 filed Sep. 6, 2011.

Extended European Search Report issued Jan. 19, 2015 in Patent Application No. 11871939.2.

* cited by examiner

ENGINE VENTILATION APPARATUS

FIELD OF THE DISCLOSURE

The present invention relates to a ventilation apparatus for an engine having a recirculation passage for recirculating blow-by gas from a crank case to an intake passage of the engine.

BACKGROUND OF THE DISCLOSURE

Conventionally, one such ventilation apparatus for an engine is described in, for example, Patent Document 1. Generally, conventional ventilation apparatuses for an engine, including the apparatus described in Patent Document 1, ensure ventilation in a crank case by drawing and recirculating blow-by gas from the interior of the crank case, into which the blow-by gas has leaked via the clearance between a piston and a cylinder, to the intake passage through a recirculation passage. In the conventional ventilation apparatuses, a recirculation passage has an opening at the end corresponding to the crank case and an opening at the end corresponding to the intake passage but does not include any other opening communicating with the exterior such that the blow-by gas cannot leak from the recirculation passage.

Blow-by gas contains oil mist, which adheres to the inner wall of the intake passage if recirculated to the intake passage together with the blow-by gas. To avoid this, the technique described in Patent Document 1 has an oil retaining groove (2), which is formed in the recirculation passage. Blow-by gas thus passes through oil retained in the oil retaining groove (2) such that oil mist is removed from the blow-by gas (see FIG. 1 of Patent Document 1).

PRIOR ART DOCUMENTS

Patent Documents

Patent Document 1: Japanese Laid-Open Patent Publication No. 5-39709

SUMMARY OF THE INVENTION

Problems that the Invention is to Solve

In this configuration, when blow-by gas is caused to strike the surface of retained oil, the blow-by gas splashes the oil or forms air bubbles in the oil, thus causing bubbling, which generates new oil mist. Accordingly, to decrease the oil mist in a favorable manner, the ventilation apparatuses need further improvement.

Accordingly, it is an objective of the present invention to provide a ventilation apparatus for an engine capable of decreasing oil mist contained in blow-by gas in a favorable manner before the blow-by gas is recirculated to an intake passage through a recirculation passage.

Means for Solving the Problems

Means for achieving the above objective and advantages thereof will now be discussed.

To achieve the foregoing objective, the present invention provides a ventilation apparatus for an engine having a recirculation passage for recirculating blow-by gas from the interior of a crank case to an intake passage of an engine. The apparatus includes an oil return passage for returning oil to an oil pan and a common portion, which is formed in the oil return passage and serves as a common internal space for the oil return passage and the recirculation passage. The common portion is a space in which oil falls under its own weight.

In this configuration, when rising in the recirculation passage to the intake passage, the blow-by gas strikes oil droplets each falling under their own weight in the common portion formed in the recirculation passage. This causes the oil mist contained in the blow-by gas to be adsorbed in the oil droplets. At this stage, the intermolecular force (the surface tension) acting to maintain each oil droplet is greater than the pressure caused by the striking oil mist. As a result, such striking does not cause bubbling. This decreases the oil mist contained in the blow-by gas in a favorable manner before the blow-by gas is recirculated to the intake passage via the recirculation passage.

In this case, a portion of the oil return passage including the common portion preferably extends in a vertical direction.

In this configuration, oil drops under its own weight in the common portion in the oil return passage.

The oil return passage is preferably a passage for returning oil from a cam chamber formed in a cylinder head to the oil pan.

In this configuration, after having been supplied to different components of the engine, the oil is discharged into the cam chamber of the cylinder head and returned to the oil pan through the oil return passage. This increases the amount of the oil flowing in the common portion. As a result, the oil mist moving in the recirculation passage hits the oil droplets falling in the common portion in a favorable manner. This promotes adsorption of the oil mist contained in the blow-by gas by the oil droplets.

The common portion is preferably arranged outside the cylinder head and the cylinder block.

Negative pressure is applied from the intake passage into the recirculation passage. Accordingly, if the volume of the common portion is insufficient, the oil sent from the oil return passage may be drawn into the intake passage through the common portion and the recirculation passage. If the common portion is formed inside the cylinder head or the cylinder block, the limited space in the cylinder head or the cylinder block cannot ensure a sufficient volume of the common portion.

However, the above-described configuration ensures appropriate setting of the volume of the common portion, thus reliably stopping the aforementioned drawing of the oil.

The oil return passage preferably includes a communicating portion that allows communication between the interior of a chain case and the recirculation passage.

In this configuration, some of the oil in the chain case is returned into the oil pan through the communicating portion and the common portion. This increases the amount of the oil flowing in the common portion. The oil mist flowing in the recirculation passage thus strikes the oil droplets falling in the common portion in a favorable manner. This promotes adsorption of the oil mist contained in the blow-by gas by the oil droplets.

The common portion is preferably a portion of the recirculation passage extending from a portion at which the recirculation passage is connected to the communicating portion to an end of the recirculation passage at the side of the oil pan.

This configuration increases the length of the common portion in the flow direction of the blow-by gas. This increases the frequency with which the oil mist strikes the oil droplets falling in the common portion. As a result, adsorption of the oil mist contained in the blow-by gas by the oil droplets is promoted.

DETAILED DESCRIPTION OF THE PREFERRED EMBODIMENTS

A ventilation apparatus for an engine according to a first embodiment of the present invention will now be described with reference to FIG. 1.

Figure 1:
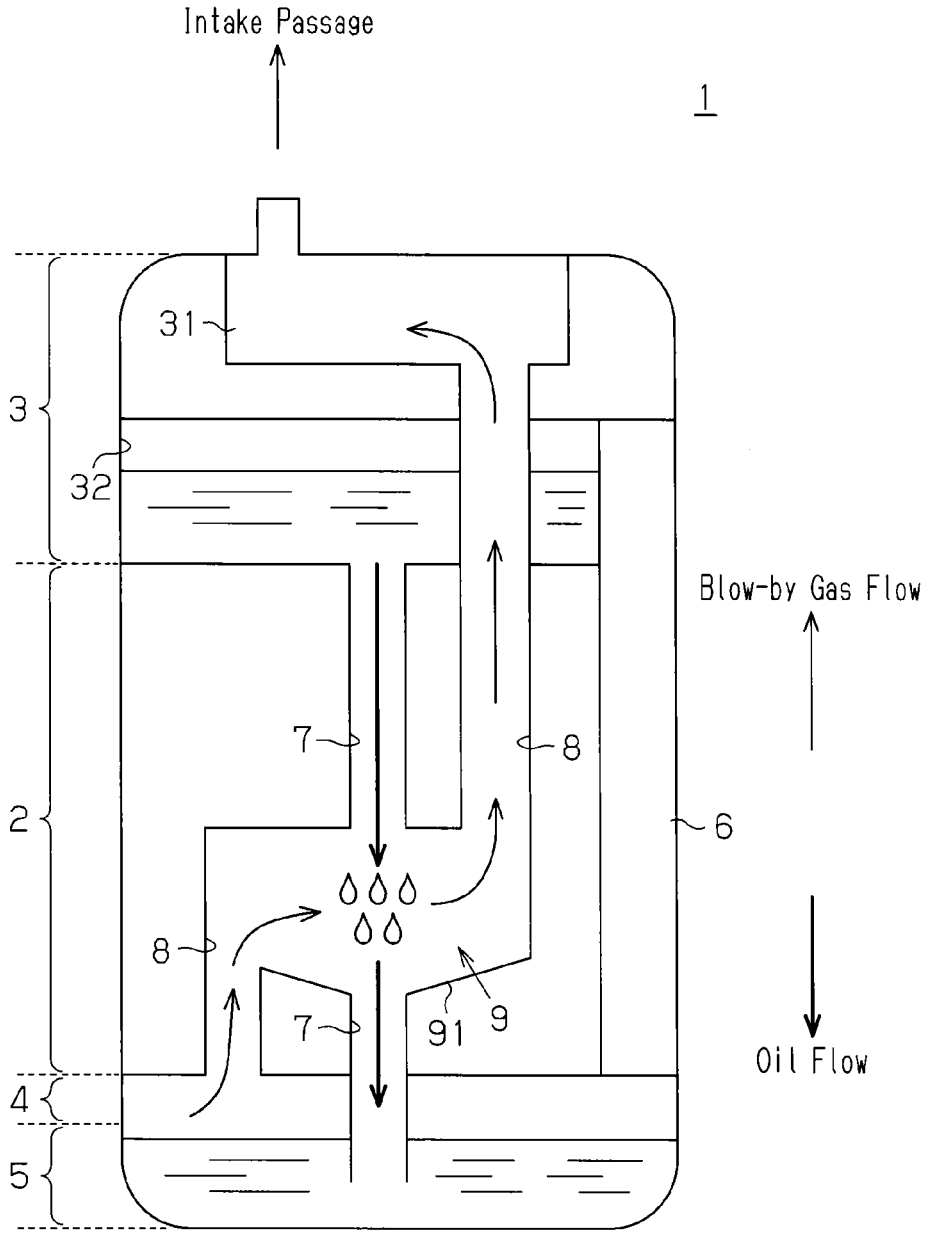
FIG. 1 is a diagram schematically showing the configuration of an engine employing a ventilation apparatus for an engine according to a first embodiment of the present invention.

FIG. 1 schematically shows the configuration of an engine 1, which employs the ventilation apparatus for an engine of according to the first embodiment. Although the engine 1 is an inline four-cylinder gasoline engine, FIG. 1 does not show reciprocating pistons or cylinders accommodating the pistons. In other words, FIG. 1 is focused mainly on a blow-by gas passage and an oil passage for illustrative purposes and omits unnecessary illustration of internal components of the engine 1.

As shown in FIG. 1, the engine 1 includes a cylinder block 2, in which cylinders are formed, and a cylinder head 3, which is arranged on top of the cylinder block 2. The cylinder head 3 receives a valve drive system including intake valves, exhaust valves, and camshafts with cams for driving the intake and exhaust valves.

A crank case 4, which accommodates a crankshaft, is located below a lower end portion of the cylinder block 2. An oil pan 5 for retaining oil is arranged below a lower end portion of the crank case 4. A chain case 6 is attached to a side surface of the cylinder block 2. The chain case 6 receives a chain for transmitting rotation of the crankshaft to the respective camshafts.

A recirculation passage 8, which is a component of the ventilation apparatus, extends in the cylinder block 2 and the cylinder head 3. An oil separator 31, which is a portion of the recirculation passage 8, is arranged in an upper end portion of the cylinder head 3. The interior of the oil separator 31 communicates with an intake passage.

A cam chamber 32 is formed in the cylinder head 3 to accommodate the aforementioned cams. The cam chamber 32 temporarily retains oil after the oil is used to lubricate components of the engine 1. An oil return passage 7, which returns the oil from the cam chamber 32 into the oil pan 5, is formed in the cylinder head 3 and the cylinder block 2. The oil return passage 7 extends vertically.

The recirculation passage 8 is connected to a portion of the oil return passage 7 and crosses the oil return passage 7 to form a cross. A portion at which the oil return passage 7 and the recirculation passage 8 cross each other (hereinafter, a common portion 9) provides a common internal space for the oil return passage 7 and the recirculation passage 8. In other words, the space formed in the common portion 9 is the space in which the oil moving in the oil return passage 7 falls under its own weight.

Operation of the first embodiment will hereafter be described.

After leaking into the crank case 4 through the clearance between any piston and the associated cylinder, the blow-by gas is drawn into the intake passage through the recirculation passage 8. Some of the oil supplied to components of the engine 1 is discharged into the cam chamber 32 of the cylinder head 3 and returned into the oil pan 5 via the oil return passage 7.

When rising in the recirculation passage 8 toward the intake passage, the blow-by gas strikes oil droplets each falling under their own weight in the common portion 9, which is located in the recirculation passage 8. The oil mist contained in the blow-by gas is thus adsorbed by the oil droplets. At this stage, the intermolecular force (the surface tension) acting to maintain each oil droplet is greater than the pressure caused by the striking oil mist. As a result, such striking does not cause bubbling.

The ventilation apparatus for an engine of the first embodiment, which has been described, has the advantages (1) and (2), as will be described below.

(1) The ventilation apparatus of the engine 1 has the recirculation passage 8, which recirculates blow-by gas from the crank case 4 to the intake passage of the engine 1. The ventilation apparatus also includes the oil return passage 7, which returns oil into the oil pan 5. The oil return passage 7 includes the common portion 9, which is the common internal space for the oil return passage 7 and the recirculation passage 8 and the space allowing the oil to fall under its own weight. Specifically, the portion of the oil return passage 7 including the common portion 9 extends in a vertical direction. This configuration decreases the oil mist contained in the blow-by gas in a favorable manner before the blow-by gas is recirculated to the intake passage via the recirculation passage 8.

(2) The oil return passage 7 returns oil from the cam chamber 32 of the cylinder head 3 into the oil pan 5. In this configuration, the oil supplied to components of the engine 1 is discharged into the cam chamber 32 of the cylinder head 3 and returned to the oil pan 5 via the oil return passage 7. This increases the amount of the oil flowing in the common portion 9. The oil mist moving in the recirculation passage 8 thus strikes falling oil droplets in the common portion 9 in a favorable manner. As a result, the oil mist contained in the blow-by gas is adsorbed by the oil droplets.

A ventilation apparatus for an engine according to a second embodiment of the present invention will hereafter be described with reference to FIG. 2.

Figure 2:
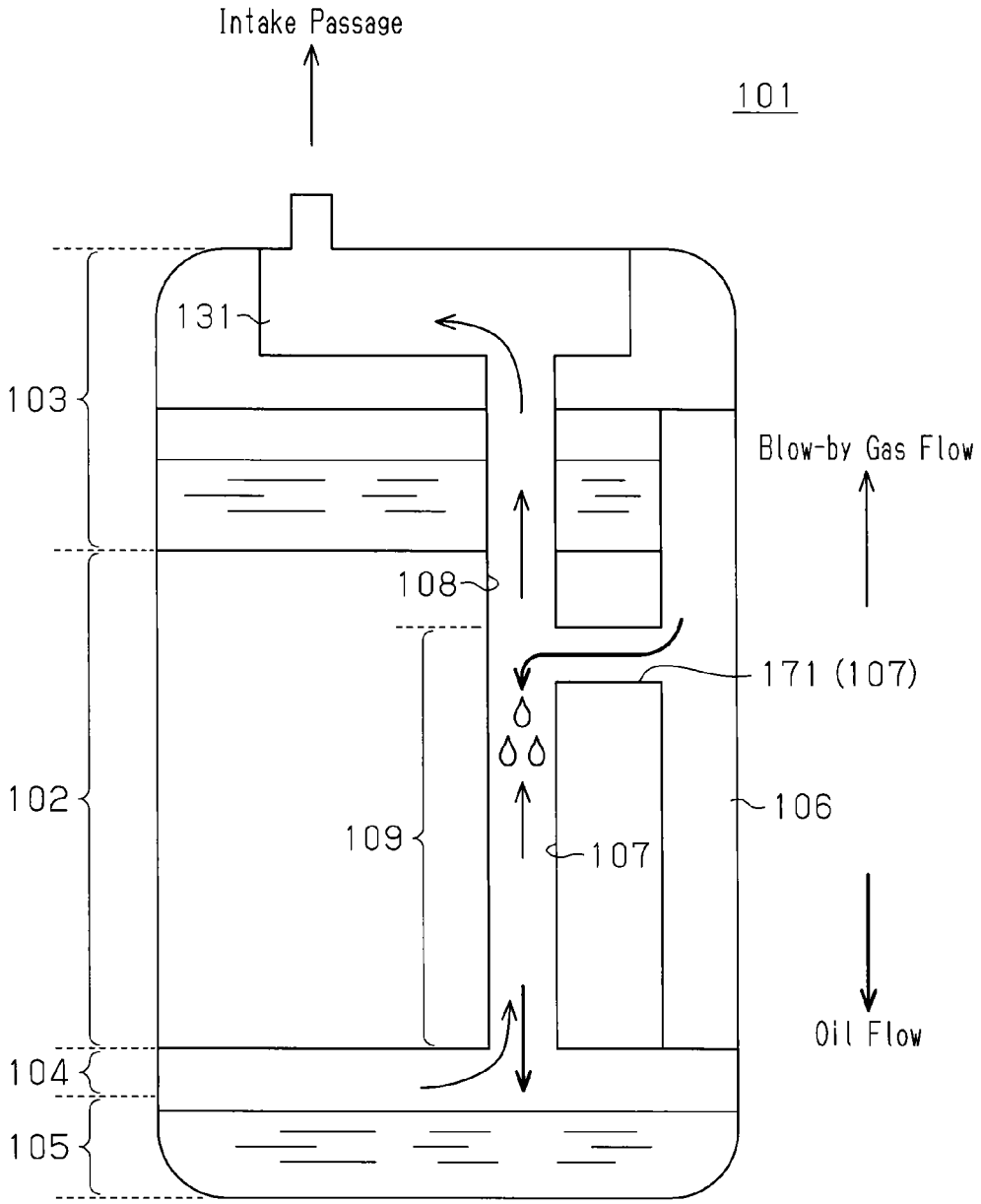
FIG. 2 is a diagram schematically showing the configuration of an engine employing a ventilation apparatus for an engine according a second embodiment of to the invention.

FIG. 2 schematically shows the configuration of an engine 101 employing the ventilation apparatus for an engine of the second embodiment.

The second embodiment is different from the first embodiment in that an oil return passage 107 does not return oil from a cam chamber into an oil pan 105. The second embodiment has a communicating portion 171 allowing communication between the interior of a chain case 106 and a recirculation passage 108. In the description below, components of the second embodiment that are like or the same as corresponding components of the first embodiment are given reference numerals determined by adding 100 to corresponding reference numerals. Description of these components is omitted herein.

With reference to FIG. 2, the recirculation passage 108, which is a component of the ventilation apparatus, extends in a cylinder block 102 and a cylinder head 103. The recirculation passage 108 extends in a vertical direction.

The communicating portion 171 is formed in the cylinder block 102 and allows communication between the interior of the chain case 106 and the recirculation passage 108. The cross-sectional area of the communicating portion 171 is smaller than the cross-sectional area of the recirculation passage 108. An oil jet mechanism for supplying oil to a chain is located in the chain case 106. After being supplied to the chain by the oil jet mechanism, the oil is splashed by the chain and then introduced into an opening of the communicating portion 171. In other words, the oil return passage 107 includes the communicating portion 171 and the portion of the recirculation passage 108 extending from the portion at which the recirculation passage 108 is connected to the communicating portion 171 to the end of the recirculation passage 108 at the side of the oil pan 105. In the oil return passage 107, the portion of the recirculation passage 108 from the portion at which the recirculation passage 108 is connected to the communicating portion 171 to the end of the recirculation passage 108 at the side of the oil pan 105 is a common portion 109. That is, the oil return passage 107 is formed by the communicating portion 171 and the common portion 109. The space formed in the common portion 109 is the space in which the oil in the oil return passage 107 falls under its own weight.

Operation of the second embodiment will hereafter be described.

After having leaked from any combustion chamber into the crank case 4 through the clearance between the corresponding piston and the cylinder, the blow-by gas is drawn into the intake passage through the recirculation passage 108. The oil agitated by the chain and the oil supplied from the oil jet mechanism to the chain and splashed by the chain are returned into the oil pan 105 after passing through the communicating portion 171 and the oil return passage 107.

When rising in the recirculation passage 108 toward the intake passage, the blow-by gas strikes oil droplets each falling under their own weight in the common portion 109, which is located in the recirculation passage 108 (the portion extending from the end of the recirculation passage 108 at the side of the oil pan 105 to the communicating portion 171). The oil mist contained in the blow-by gas is thus adsorbed by the oil droplets. At this stage, the intermolecular force acting to maintain each oil droplet is greater than the pressure caused by the striking oil mist. As a result, such striking does not cause bubbling.

The ventilation apparatus for an engine of the second embodiment, which has been described, has the advantages (3), (4), and (5), as will be described below, in addition to the advantage (1) of the first embodiment.

(3) The oil return passage 107 has the communicating portion 171, which allows communication between the interior of the chain case 106 and the recirculation passage 108. In this configuration, some of the oil in the chain case 106 is returned into the oil pan 105 through the communicating portion 171 and the common portion 109. This increases the amount of the oil flowing in the common portion 109. The oil mist flowing in the recirculation passage 108 thus strikes falling oil droplets in the common portion 109 in a favorable manner. This allows the oil mist contained in the blow-by gas to be adsorbed by the oil droplets.

(4) The common portion 109 is a portion of the recirculation passage 108 extending from the portion at which the recirculation passage 108 is connected to the communicating portion 171 to the end of the recirculation passage 108 at the side of the oil pan 105. This configuration increases the length of the common portion 109 in the flow direction of the blow-by gas, thus increasing the frequency with which the oil mist strikes the oil droplets falling in the common portion 109. As a result, the oil mist contained in the blow-by gas is adsorbed by the oil droplets in a favorable manner.

(5) The communicating portion 171 has a smaller cross-sectional area than the recirculation passage 108. If the cross-sectional area of the communicating portion is greater than or equal to the cross-sectional area of the recirculation passage, the blow-by gas may leak into the chain case through the communicating portion, which allows communication between the recirculation passage and the interior of the chain case. However, in the second embodiment, the cross-sectional area of the communicating portion 171 is smaller than the cross-sectional area of the recirculation passage 108. The interior of the communicating portion 171 is thus maintained in a state sealed by the oil. This makes it unlikely, in a favorable manner, that the blow-by gas leaks into the interior of the chain case 106 through the communicating portion 171.

The ventilation apparatus for an engine according to the present invention is not restricted to the configurations of the illustrated embodiments but may be embodied in any suitable modified forms including, for example, the forms described below.

Figure 3:
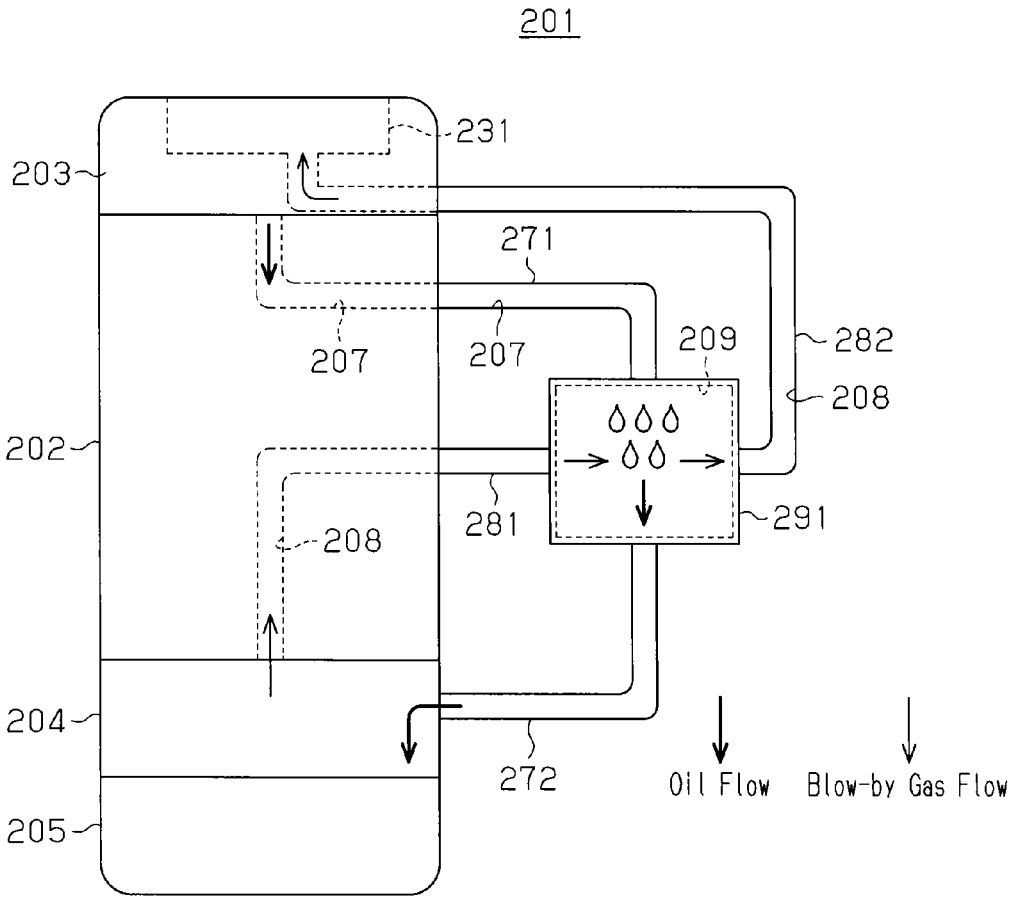
FIG. 3 is a diagram schematically showing the configuration of a ventilation apparatus for an engine according to a modification of the first embodiment.

In the first embodiment, the common portion 9 is formed inside the cylinder block 2 (see FIG. 1). However, since negative pressure is applied from the intake passage into the recirculation passage 8, the oil sent from the oil return passage 7 is likely to be drawn into the intake passage through the common portion 9 and the recirculation passage 8 unless the volume of the common portion 9 is sufficiently large. If the common portion 9 is formed inside the cylinder block 2, the limited space in the cylinder block 2 possibly does not allow the common portion 9 to have a sufficient volume. In this case, as illustrated in FIG. 3, a common portion 209 may be arranged outside a cylinder head 203 and a cylinder block 202. Specifically, an upstream pipe 281 and a downstream pipe 282, which configure a recirculation passage 208, are arranged outside the cylinder block 202 and the cylinder head 203. A case 291, which has a cross-sectional area greater than the cross-sectional area of each of the pipes 281, 282, is arranged between and connected to the upstream pipe 281 and the downstream pipe 282. An upstream pipe 271 and a downstream pipe 272, which configure an oil return passage 207, are formed outside the cylinder block 202 and the cylinder head 203. The case 291 is arranged between and connected to the upstream pipe 271 and the downstream pipe 272. The cross-sectional area of the case 291 is greater than the cross-sectional area of each of the upstream and downstream pipes 271 and 272. The interior of the case 291 is a common portion 209, which is the space in which oil falls under its own weight. This configuration allows appropriate setting of the volume of the common portion 209 such that the aforementioned oil drawing is reliably avoided.

In the second embodiment, the common portion 109 is the portion of the recirculation passage 108 extending from the portion at which the recirculation passage 108 is connected to the communicating portion 171 to the end of the recirculation passage 108 at the side of the oil pan 105. However, the present invention is not restricted to this configuration. For example, the oil return passage and the recirculation passage may cross each other to form a cross as in the first embodiment and its modification. Alternatively, the angle at which the oil return passage and the recirculation passage cross each other is not restricted to 90 degrees but may be changed to any other suitable value as needed.

In the second embodiment, the cross-sectional area of the communicating portion 171 is smaller than the cross-sectional area of the recirculation passage 108. Such sizing is desirable for maintaining the interior of the communicating portion 171 in a state sealed by oil and thus making it unlikely that blow-by gas leaks into the interior of the chain case 106 through the communicating portion 171. However, as long as such leakage of the blow-by gas does not occur, the cross-sectional area of the communicating portion may be greater than or equal to the cross-sectional area of the recirculation passage.

In the illustrated embodiments and modification, the oil return passage returns oil to the oil pan after the oil has been used to lubricate components of the engine. However, as long as the oil is returned to the oil pan by the oil return passage, the oil may be returned before being used to lubricate the components of the engine.

DESCRIPTION OF THE REFERENCE NUMERALS

1, 101, 201 . . . Engine, 2, 102, 202 . . . Cylinder Block, 3, 103, 203 . . . Cylinder Head, 31, 131, 231 . . . Oil Separator, 32 . . . Cam Chamber, 4, 104, 204 . . . Crank Case, 5, 105, 205 . . . Oil Pan, 6, 106 . . . Chain Case, 7, 107, 207 . . . Oil Return Passage, 8, 108, 208 . . . Recirculation Passage, 9, 109, 209 . . . Common Portion, 171 . . . Communicating Portion, 271 . . . Upstream Pipe, 272 . . . Downstream Pipe, 281 . . . Upstream Pipe, 282 . . . Downstream Pipe, 291 . . . Case

The invention claimed is:

1. A ventilation apparatus for an engine having a recirculation passage for recirculating blow-by gas from the interior of a crank case to an intake passage of an engine, the apparatus comprising:

an oil return passage for returning oil in an oil pan; and a common portion, which is formed in the oil return passage and serves as a common internal space for the oil return passage and the recirculation passage, wherein the common portion is a space in which the oil falls under its own weight, wherein the common portion is arranged outside the cylinder head and the cylinder block.

2. The ventilation apparatus for an engine according to claim 1, wherein a portion of the oil return passage including the common portion extends in a vertical direction.

3. The ventilation apparatus for an engine according to claim 1, wherein the oil return passage is a passage for returning oil from a cam chamber formed in a cylinder head to the oil pan.

4. A ventilation apparatus for an engine having a recirculation passage for recirculating blow-by gas from the interior of a crank case to an intake passage of an engine, the apparatus comprising:

an oil return passage for returning oil to an oil pan, wherein the oil return passage includes a communicating portion that allows communication between the interior of a chain case and the recirculation passage; and a common portion, which is formed in the oil return passage and serves as a common internal space for the oil return passage and the recirculation passage, wherein the common portion is a space in which the oil falls under its own weight.

5. The ventilation apparatus for an engine according to claim 4, wherein the common portion is a portion of the recirculation passage extending from a portion at which the recirculation passage is connected to the communicating portion to an end of the recirculation passage at the side of the oil pan.

6. The ventilation apparatus for an engine according to claim 4, wherein a portion of the oil return passage including the common portion extends in a vertical direction.

* * * * *